United States Patent [19]

Caems et al.

[11] Patent Number: 4,866,340

[45] Date of Patent: Sep. 12, 1989

[54] EXPLOSION RESISTANT TUNGSTEN-HALOGEN INCANDESCENT LAMP

[75] Inventors: Josephus F. Caems; Leo F. M. Ooms, both of Eindhoven, Netherlands

[73] Assignee: U.S. Philips Corporation, New York, N.Y.

[21] Appl. No.: 290,853

[22] Filed: Dec. 28, 1988

Related U.S. Application Data

[63] Continuation of Ser. No. 581,149, Feb. 17, 1984, abandoned.

[30] Foreign Application Priority Data

Mar. 3, 1983 [NL] Netherlands ..... 8300781

[51] Int. Cl.[4] ..... H01K 1/18

[52] U.S. Cl. ..... 313/579; 313/580

[58] Field of Search ..... 313/579, 580, 590, 276, 313/345, 578

[56] References Cited

U.S. PATENT DOCUMENTS 1,647,647 11/1927 McKay et al. ..... 313/580 X
1,715,580 6/1929 Turner ..... 313/580 X
4,262,229 4/1981 Bienvenue et al. ..... 313/579

FOREIGN PATENT DOCUMENTS 999773 7/1965 United Kingdom ..... 313/579

*Primary Examiner*—Kenneth Wieder
*Attorney, Agent, or Firm*—Brian J. Wieghaus; David R. Treacy

[57] ABSTRACT

A halogen incandescent lamp has current-supply conductors, at least one of which is enclosed by an insulator tube which is anchored in the wall of the lamp envelope and extends beyond the end of this current-supply conductor as far as the proximity of the filament. The insulator tube protects the lamp during operation in series arrangement at mains voltage from exploding at the end of its life due to overheating by an arc discharge. The speed at which a discharge arc is extinguished can be increased by enclosing each current-supply conductors in its own insulator tube and is further improved if nitrogen or helium is used as an inert gas.

8 Claims, 1 Drawing Sheet

EXPLOSION RESISTANT TUNGSTEN-HALOGEN INCANDESCENT LAMP

This is a continuation of application Ser. No. 581,149, filed Feb. 17, 1984, now abandoned.

BACKGROUND OF THE INVENTION

The invention relates to a halogen incandescent lamp, comprising a light-transmitting lamp envelope which is sealed in a vacuum-tight manner and through whose wall current-supply conductors extend into the cavity of the lamp envelope where they are connected to the ends of a filament. The cavity is filled with a halogen-containing inert gas. Such a lamp is known from, for example, British Patent Specification 2,025,127.

It is advantageous to design halogen incandescent lamps for use at a low voltage because the filament then has small dimensions and the emitted light can then be concentrated very effectively. The term "low voltage" is to be understood herein to mean a voltage which is at most half the mains voltage. If, however, a large number of low-voltage lamps has to be used, this has the disadvantage that many transformers are required or that, when only one or a few transformers are employed, very high currents flow in the secondary circuit.

These disadvantages could be avoided if the lamps were operated in series-combination at mains voltage, but the risk of lamp explosions then occurs. In fact, if the filament of a lamp of the series burns through at the end of its life, a discharge arc may be obtained. In the long run, this arc may swell, touch the wall of the lamp envelope and may overheat that wall, after which the lamp envelope explodes.

The risk of explosion is not eliminated by including a fuse in the current circuit because the remaining lamps in the series-combination limit the current through the circuit so that this current is not or substantially not larger when a discharge arc has been obtained in a lamp.

Even if the gas filling of the lamp is chosen so that the discharge arc has a high re-ignition voltage, the re-ignition of the arc cannot be prevented. This is because, after each zero passage of the voltage, mains voltage is applied across the defective lamp before a current starts to flow again through the circuit. Moreover, lamps operated at a low voltage are generally small and the distance between the points to which a discharge arc applies is consequently also small.

SUMMARY OF THE INVENTION

The invention has for its object to provide a halogen incandescent lamp in which a discharge arc is rapidly extinguished and explosion of the lamp envelope is prevented.

According to the invention, in a halogen incandescent lamp at least one of the current-supply conductors is enclosed by an insulator tube which is anchored in the wall of the lamp envelope and which extends as far as the proximity of the filament and, if the part of the current-supply conductor located in the cavity of the lamp envelope consists of a thicker wire than the wire of the filament, the insulator tube extends beyond the end of the thick current-supply conductor located in the cavity of the lamp envelope.

It may be advantageous if the remaining current-supply conductor is also enclosed by such an insulator tube.

This measure cause a discharge arc to be extinguished even more rapidly.

A further speeding-up of the extinction of the discharge arc may be obtained by using a gas filling which provides a higher resistance in the discharge arc and hence a higher energy dissipated by the discharge arc. Such a gas filling is, apart from the halogen component, helium, nitrogen or a gas mixture having a content of at least one of these gases.

A filament melts at the end of its life at the hottest area. In general this area is located at the center of the filament, but it may alternatively be located outside the center if the wire of the filament at that area has a thinner region due to an imperfection. The discharge arc then obtained causes the filament to melt away increasingly and the arc extends increasingly further towards one or both current-supply conductors. Without the use of an insulator tube enclosing the current-supply conductor, the arc could be maintained for a long time with the current-supply conductors serving as the electrodes. In order to limit losses of energy in these conductors during normal operation of the lamp, but also in order to support the filament mechanically to a sufficient extent, these current-supply conductors may in fact be thicker than the material from which the filament is formed. However, also in cases where the current-supply conductors consist of a wire of equal thickness or of the same wire as that from which the filament is wound, the situation may arise that, without the measure according to the invention being taken, an arc is maintained for such a long time that explosion occurs.

If a discharge arc has grown to such an extent that it penetrates into an insulator tube, the discharge arc is forced to contract and the resistance of the arc and the voltage across the arc increases. Melting and evaporating metal in the insulator tube increases the gas pressure in the tube. As a result, the arc is caused to extinguish.

If both current-supply conductors are enclosed by respective insulator tubes, it is not important which current-supply conductor is reached first by the discharge arc. If only one current-supply conductor is enclosed in an insulator tube, a longer period of time elapses before the arc extinguishes if the non-enveloped current-supply conductor is first reached by the arc. However, also in the latter case the lamp according to the invention has proved to be reliable.

Nitrogen or helium as the, or as an inert-gas component of, the gas filling accelerates the process of melting of the filament and shortens the lapse of time between the instant at which the arc is obtained and the instant at which a current-supply conductor is reached by the arc.

Since the insulator tube is located in part in the proximity of the filament, a material capable of withstanding high temperatures, such as quartz glass or glass having a very high content by weight (for example 95% or more) of $SiO_2$, is chosen for this tube. It will be appreciated that the extinction of a discharge arc in a lamp according to the invention is independent of the operating position of the lamp.

U.S. Pat. No. 1,715,580 discloses a lamp for general illumination purposes in which two concentric glass tubes are arranged around each of the two thick current-supply conductors, of which tubes one is fixed to the stem tube and the other is displaceable. The current-supply conductors each project from the relevant tubes with their ends located within the lamp envelope. A thin wire is stretched from this end of each of the current-supply conductors to a glass body secured to the stem tube, as a result of which the displaceable glass tubes are held in position. If a discharge arc is produced in the lamp, at least one of the thin wires has to fuse. The displaceable glass tube is then no longer held and must move over and beyond the end of the current-supply conductor until it abuts against the wall of the lamp envelope. As a result, the current-supply conductor is insulated entirely from its surroundings by glass and the discharge arc extinguishes.

Both the operation and the construction of the lamp according to this U.S. Patent are essentially different from those of the lamp according to the invention. According to the Patent, the comparatively thick current-supply conductor is enclosed throughout its length by an insulator tube only after an arc has been produced. The current-supply conductor is then entirely insulated. According to the present invention, the current-supply conductor has been enclosed throughout its length already from the beginning in case it consists of a thicker wire than that from which the filament is wound. Even if a discharge arc occurs, this conductor is not screened completely.

The lamp according to the aforementioned Patent has a complicated construction with moving parts and a high consumption of material. The lamp according to the invention is very simple and requires only a small quantity of material.

The lamp according to the U.S. Patent also has the great disadvantage that it extinguishes a discharge arc only if the thin wire fuses, while it is not certain at all that this wire will be causes to fuse because the arc applies not to this wire, but to the current-supply conductor. A further very important disadvantage of the lamp according to that Patent is, that an essential condition for causing the arc to extinguish is that the lamp is operated in a base-up position. In any other operating position the displaceable glass tube is in fact not displaced. In the lamp according to the present invention, on the contrary, the arc is caused to extinguish independently of the operating position of the lamp.

Embodiments of lamps according to the invention are shown in the drawings.

DESCRIPTION OF THE PREFERRED EMBODIMENTS

Figure 1:
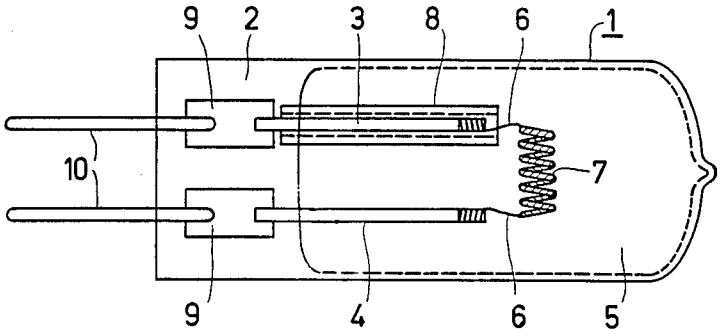
FIG. 1 is a side elevation of a first embodiment of the invention.

In FIG. 1, the lamp has a lamp envelope 1 which is sealed in a vacuum-tight manner and is provided at one end with a pinch 2. Current-supply conductors 10, 9, 3; 10, 9, 4 extend through the pinch portion of the wall, into the cavity 5 of the lamp envelope where they are connected to the ends 6 of a coiled coil filament 7 arranged in the cavity. The current-supply conductor 3 is enclosed by an insulator tube 8, which is anchored in the the pinch 2 portion of the wall, and surrounds the conductor with capillary clearance and is made, like the lamp envelope 1, of quartz glass. The tube 8 extends beyond the end of the current-supply conductor 10, 9, 3 located in the cavity 5. This conductor consists of an external current-supply conductor 10, which is welded to a metal foil 9 to form a current lead-through conductor, which at its other end is welded to an internal current conductor 3. The lamp envelope is filled with a halogen-containing inert gas.

Figure 2:
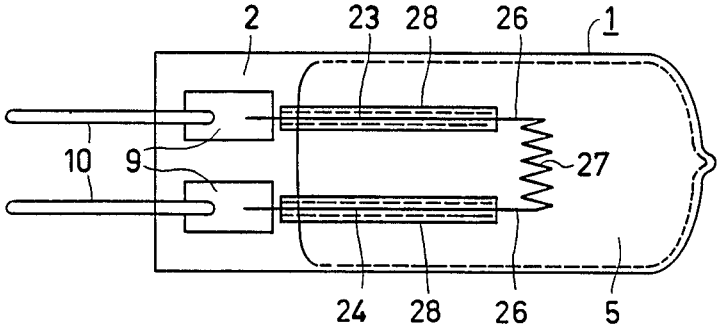
FIG. 2 is a side elevation of a second embodiment.

In FIG. 2, corresponding parts are designated by like reference numerals. In this Figure, both current-supply conductors 10, 9, 23; 10, 9, 24 are enclosed by an insulator tube 28. The lamp has a single coil filament 27. The parts 23, 24 of the current-supply conductors located in the cavity 5 are integral with a respective end 26 of the filament 27.

Figure 3:
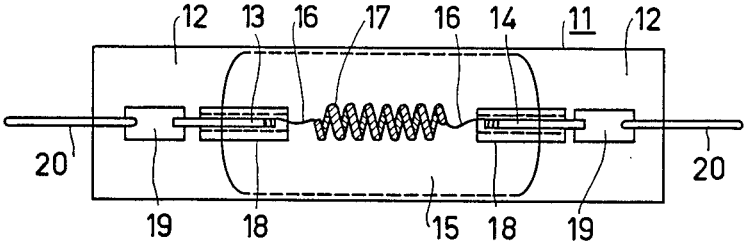
FIG. 3 is a side elevation of a third embodiment.

In FIG. 3, corresponding parts are designated by reference numerals which are 10 higher than in FIG. 1. The lamp shown is a two-pinch lamp in which both current-supply conductors 20,19,13 and 20,19,14 have an insulator tube 18. The lamp, like that shown in FIG. 2, is filled with halogen-containing inert gas.

Lamps were constructed having two insulator tubes, but otherwise having the construction shown in FIG. 1, filled 3 Bar pressure of inert gas containing 0.15% by volume of $CH_2Br_2$. Six such lamps, each having a power consumption of 150 W, were connected in series across a 240 V supply. During operation, the filament of one of the lamps was burned through by means of a laser. A discharge arc was then produced, whose length increased. When an insulator tube 8 was reached, the arc extinguished.

When krypton was used as inert gas, the length of the arc increased only slowly, but the dimension of the arc in transverse direction remained strongly limited so, that, also due to the fact that the arc current was kept limited by the remaining lamps, the temperature of the lamp envelope substantially did not increase. Due to the small energy content of the discharge arc, a period of 5 seconds elapsed before the arc had grown as far as the insulator tube and extinguished. The lamp envelope then was still completely intact. The internal current conductors 3, 4 were prevented from maintaining an arc.

A similar experiment was carried out with lamps of identical construction in which as inert gas nitrogen was used instead of krypton. The length of the discharge arc increased rapidly, as a result of which in less than 1 second an insulator tube was reached and the arc extinguished, while the lamp envelope was still completely intact.

What is claimed is:

1. A tungsten-halogen incandescent lamp, comprising:

a light-transmitting envelope, sealed in a vacuum-tight manner, and having a wall surrounding a cavity, a filament arranged in the cavity, a plurality of current supply conductors extending through said wall, each having a respective portion extending within the cavity, and a respective end connected to said filament, at least said portion of one conductor having a wire cross section thicker than said filament, and a halogen-containing inert gas filling the cavity, characterized by comprising an electrical insulator tube enclosing one of said current supply conductors, said tube having a first end portion embedded in said wall, said tube extending from the wall beyond the end of said thicker portion to a second tube end which is disposed in the proximity of said filament.

2. A lamp as claimed in claim 1, having two only of said conductors, and two only said insulator tubes, each tube enclosing a respective conductor.

3. A lamp as claimed in claim 2, characterized in that the inert gas comprises at least one of the gases nitrogen and helium.

4. A lamp as claimed in claim 1, characterized in that the inert gas comprises at least one of the gases nitrogen and helium.

5. In an incandescent lamp havin a lamp vessel sealed in a gas-tight manner and having a vessel wall, a wire filament arranged within said lamp vessel, and a pair of wire current-supply conductors extending through said vessel wall each having an internal portion extending within said vessel and having an end connected to said filament, the portion of said current-supply conductors extending within said vessel having substantially the same diameter as said filament wire, the improvement comprising:

an electrical insulator tube enclosing said internal portion of a said current-supply conductor for extinguishing a discharge arc resulting from burn-through of said filament during lamp operation, said tube having a first end portion embedded in said vessel wall and extending substantially along the entire length of said current-supply conductor and terminating at a second tube end proximate said conductor end connected to said filament, the location of said second tube end being selected such that, upon burn-through of said filament resulting in a discharge arc occurring between filament parts which arc progressively melts the filament parts and current-supply conductors, said arc progresses towards and enters said electrical insulator tube through said second tube end and is extinguished with sufficient rapidity to prevent overheating of said discharge vessel resulting in failure of said discharge vessel.

6. A lamp as claimed in claim 5, wherein a said electrical insulator tube encloses each of said current-supply conductors.

7. A lamp as claimed in claim 6, wherein said outer envelope is filled with an inert gas comprising halogen and at least one of the gases nitrogen and helium.

8. A lamp as claimed in claim 5, wherein said outer envelope is filled with an inert gas comprising halogen and at least one of the gases nitrogen and helium.

* * * * *